United States Patent [19]

Dass

[11] Patent Number: 5,046,989

[45] Date of Patent: Sep. 10, 1991

[54] COIN STORAGE AND DISPENSING APPARATUS

[75] Inventor: Jack D. Dass, Santa Clara, Calif.

[73] Assignees: Jack Dass; Charles F. Popham, both of Carson City, Nev.

[21] Appl. No.: 449,285

[22] Filed: Dec. 5, 1989

Related U.S. Application Data

[63] Continuation of Ser. No. 192,534, Aug. 18, 1988, abandoned.

[51] Int. Cl.[5] ..... G07D 9/04

[52] U.S. Cl. ..... 453/17; 194/344; 221/200; 221/267; 453/32; 453/33; 453/50

[58] Field of Search ..... 453/13, 17, 32, 33, 453/40, 49, 50, 57; 194/200, 344; 221/203, 267, 301, 307, 200

[56] References Cited

U.S. PATENT DOCUMENTS

| | | | |
|---|---|---|---|
| 1,096,419 | 5/1914 | Farnsworth | 453/33 |
| 1,863,150 | 6/1932 | Allen | 453/50 X |
| 4,261,377 | 4/1981 | Ueda | 453/32 X |
| 4,342,384 | 8/1982 | Fukase et al. | 453/56 X |
| 4,398,550 | 8/1983 | Shireman | 453/57 X |
| 4,518,001 | 5/1985 | Branham | 221/267 X |
| 4,589,433 | 5/1986 | Abe | 221/203 X |
| 4,592,377 | 6/1986 | Paulsen et al. | 453/33 |

FOREIGN PATENT DOCUMENTS

| | | | |
|---|---|---|---|
| 2528753 | 1/1977 | Fed. Rep. of Germany | 453/57 |

*Primary Examiner*—F. J. Bartuska

*Attorney, Agent, or Firm*—Heller, Ehrman, White & McAuliffe

[57] ABSTRACT

A coin storage and dispensing apparatus comprising a coin hopper assembly and a coin track assembly is disclosed for orienting coins in edge-to-edge relationship in the coin track assembly, and for dispensing coins from the coin track assembly at an elevation higher than that of the coin hopper. An impact drive assembly for preventing damage to the drive or gear box when a coin jam occurs or there is a malfunction in the coin hopper or coin track assembly is also disclosed. The coin storage and dispensing apparatus also incorporates an improved coin counter device, an anti-theft device, and a coin ejector for propelling coins from the exit slot.

26 Claims, 11 Drawing Sheets

COIN STORAGE AND DISPENSING APPARATUS

This is a continuation of application Ser. NO. 192,534 filed Aug. 18, 1988, now abandoned.

TECHNICAL FIELD

The present invention relates generally to a coin storage and dispensing apparatus for use with coin or token operated games, coin counting apparatus, and the like. The present invention relates more specifically to a coin storage and dispensing apparatus wherein coins are collected in a generally horizontally oriented coin hopper, the coins are conveyed through a coin track assembly in edge-to-edge relationship, and a predetermined number of coins is ejected during a payout or the like, at coin output level higher than the storage hopper.

BACKGROUND ART

Many types of coin handling apparatus are known in the art for use with coin operated games, such as slot machines, coin counting apparatus, and the like. Rapid, accurate, and reliable coin counting and coin dispensing during payouts are important features of coin counting and dispensing apparatus. Moreover, in many applications, it is desirable to provide transfer of coins from a collection hopper to a coin tray which is elevated with respect to the hopper. Additionally, coin handling apparatus must accommodate discrepancies in coin dimensions without causing jamming, inaccurate counting, or unauthorized release of coins. U.S. Pat. No. 3,783,885 teaches a disc dispensing apparatus having upper and lower relatively rotatable plates for dispensing coins in controlled quantities. The coin hopper taught by the '885 patent has tapered side walls and is arranged at an angle of about 30° to the horizontal. U.S. Pat. Nos. 3,942,544 and 4,036,242 teach coin hopper payout apparatus which may be readily modified for use with a wide variety of coin diameters and thicknesses, and they are illustrative of conventional types of coin hopper payout mechanisms. According to the teachings of the '544 and '242 patents, an angled, rotating pinwheel is arranged interiorly of a scoop-shaped coin hopper, and coin counting is achieved by means of a lever arm. The lever arm, however, generally cannot accommodate coins having different diameters or thicknesses due to coin wear, which results in inaccurate coin release, causing unauthorized overpayment or underpayment during payouts. In addition, coin hopper payout devices of the type taught by the '544 and '242 patents require numerous adjustments for functional operation of the coin hopper. Furthermore, in coin hopper payout devices of this type, the drive motor is linked directly to the pinwheel and, in the event one or more coins become jammed in the pinwheel area, the motor gear box may be damaged extensively. Coin hopper payout devices of this type comprise many moving and non-moving parts and are expensive to assemble and service.

U.S. Pat. Nos. 4,518,001 and 4,592,377 teach coin handling apparatus having an elongated duct for transferring coins in an edge-to-edge relationship from a coin hopper to an elevated coin tray. The coin handling apparatus taught by the '001 and '377 patents are generally mounted on coin hopper payout apparatus of the type taught in the '544 and '242 patents to provide release of a predetermined number of coins at an outlet slot elevated from the coin hopper mechanism. Coins are elevated in a coin handling escalator assembly having a channel for receiving coins of a particular denomination in edge-to-edge relationship, and having a coin ejector at the upper, exit end of the coin handling escalator assembly comprising a roller rotatably mounted on an axle, both mounted on a hinged bracket. The ejector assembly acts as a stop for the uppermost coin in the chute by maintaining contact with the coin. The ejector assembly taught by the '001 patent, however, is prone to tampering by rotation of the hinged bracket to permit the unauthorized release of coins. The '377 patent teaches a security device to prevent the coin nearest the outlet slot from being released unless the adjacent coin is moved simultaneously and with equal speed toward the outlet slot.

The spacing of pins on conventional pinwheels employed in conventional coin handling apparatus causes disruption and bumping of coins as they are transferred from the pinwheel and enter the coin escalator portion of the apparatus. Bumping of coins at the interface of the coin hopper and the escalator device is transmitted through the coins arranged in edge-to-edge relationship in the escalator, which promotes coin jams, particularly at the curved or angled portion of the coin escalator apparatus. In addition, bumping of coins at the coin hopper outlet creates vibration of the coin escalator apparatus and mounting hardware, which results in loosening and misalignment of the coin escalator apparatus.

Accordingly, it is an objective of the present invention to provide an improved coin storage and dispensing apparatus for collecting coins in a coin hopper and conveying coins in an edge-to-edge relationship through a coin track assembly to release coins, during a payout or the like, at an elevated level with respect to the coin hopper assembly.

It is another objective of the present invention to provide a coin storage and dispensing apparatus of the type described above which is relatively inexpensive to manufacture and assemble, and which does not require numerous adjustments to maintain functional operation.

It is yet another objective of the present invention to provide a coin storage and dispensing apparatus including an impact drive assembly for preventing damage to the drive means or gear box when a coin jam occurs or the coin hopper assembly or coin track assembly malfunctions.

It is still another objective of the present invention to provide a coin storage and dispensing apparatus including an improved counting mechanism providing accurate counting of coins during a payout or the like.

It is yet another objective of the present invention to provide a coin storage and dispensing apparatus including an anti-theft mechanism to prevent unauthorized removal of coins from the coin track assembly.

It is still another objective of the present invention to provide a coin storage and dispensing apparatus providing improved clearance of coins from the exit slot of the coin track assembly during authorized payouts.

SUMMARY OF THE INVENTION

The coin storage and dispensing apparatus of the present invention comprises a horizontally arranged coin hopper assembly including a coin bowl mounted on a hopper base and a rotatable coin disk operatively engaged with a drive means for rotation and having a plurality of coin pockets therein, the hopper base having a coin gutter for receiving coins from the coin pockets, and a coin track assembly having a coin channel therein sized to permit passage of coins in edge-to-edge relationship, and including a generally horizontal portion and a generally vertical portion joined by a curved intermediate portion and a coin exit slot having a higher elevation than that of the coin hopper assembly.

In a conventional coin operated game apparatus, for example, coins are inserted by the player in a coin receiving slot, and they are deposited directly in the coin hopper assembly. Coins are collected and stored in the hopper assembly and, when a player wins for example, a predetermined number of coins is conveyed from the coin hopper assembly through the coin track assembly in edge-to-edge relationship and ejected from a coin exit slot. The coin storage and dispensing apparatus of the present invention incorporates an improved counting mechanism to provide accurate coin counting during a payout or the like. A preferred embodiment of the coin storage and dispensing apparatus of the present invention also includes an impact drive assembly for preventing damage to the drive means or gearbox when a coin jam occurs in the coin hopper assembly or the coin track assembly. An improved anti-theft mechanism is preferably provided to prevent unauthorized removal of coins from the coin track assembly, and an ejector means for impelling tokens from the exit slot of the token track assembly may also be provided.

BRIEF DESCRIPTION OF THE DRAWINGS

The above-mentioned and additional features of the present invention and the manner of obtaining them will become apparent, and the invention will be best understood by reference to the following more detailed description read in conjunction with accompanying drawings, in which.

DESCRIPTION OF THE PREFERRED EMBODIMENT OF THE INVENTION

Figure 1:
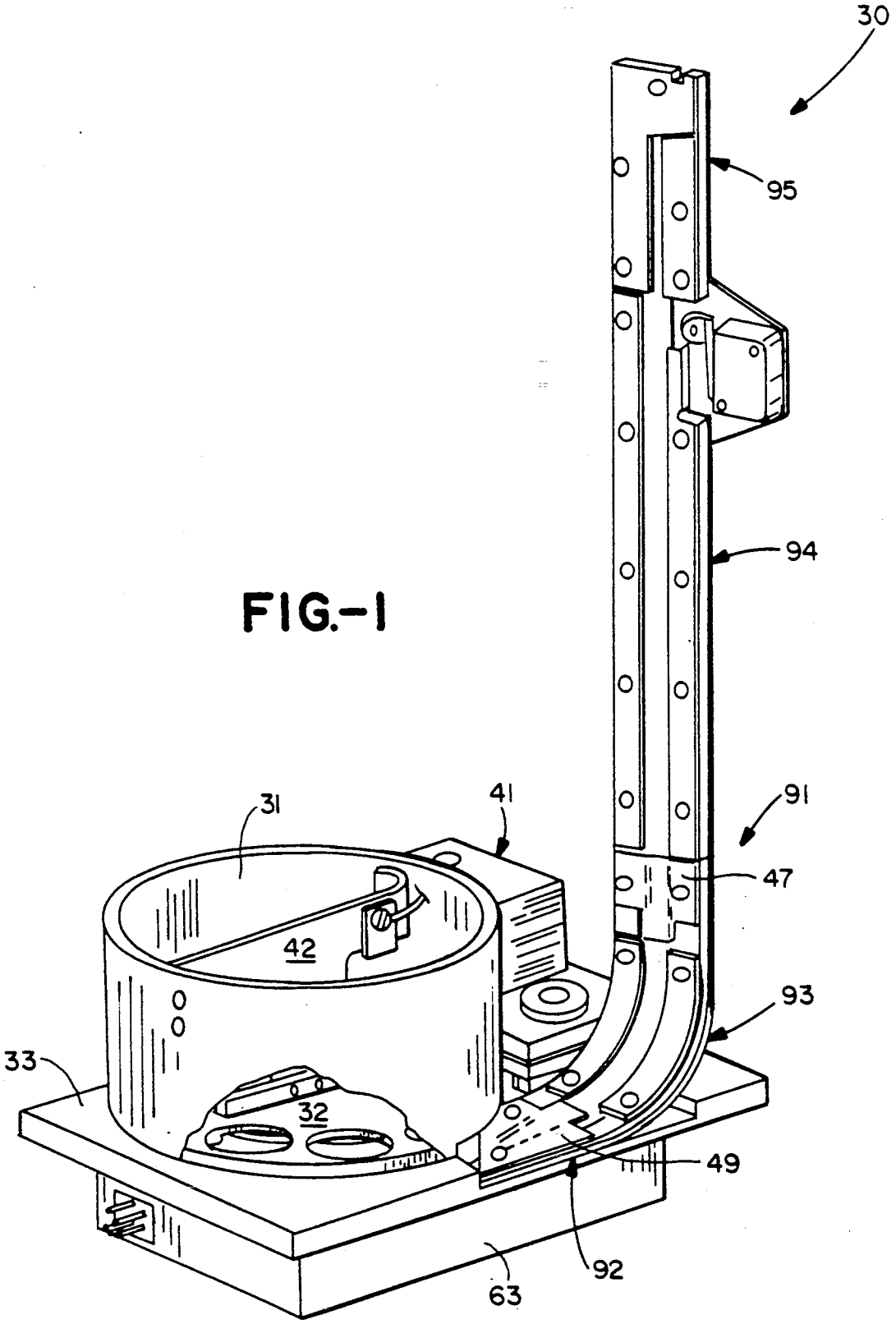
FIG. 1 shows a perspective view of a coin storage and dispensing apparatus according to the present invention.
Figure 2:
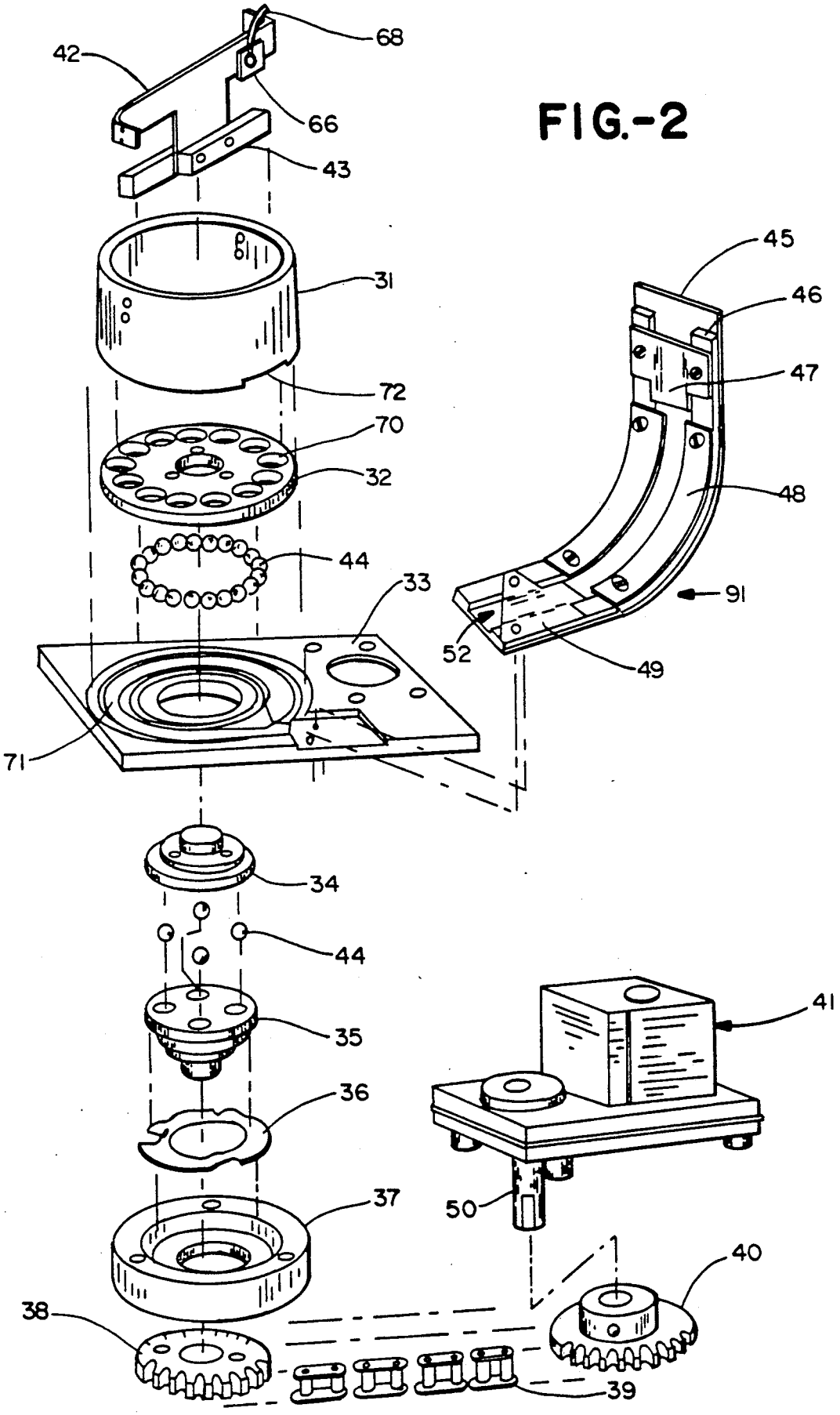
FIG. 2 shows an exploded perspective view of the coin storage and dispensing apparatus of FIG. 1 with an upper portion of the coin track assembly removed.

FIGS. 1 and 2 illustrate the principle components of coin storage and dispensing apparatus 30 of the present invention. Coin storage and dispensing apparatus 30 comprises a coin hopper assembly including hopper bowl 31, coin disk 32, a plurality of ball bearings 44, hopper base 33 provided with coin gutter 71, drive motor 41 for rotating coin disk 32, and coin track assembly 91 mounted on the hopper base for dispensing coins at an elevated level with respect to the coin hopper. A preferred embodiment of coin storage and dispensing apparatus 30 incorporates mixer bracket 42 with flexible fingers 43 mounted in the hopper bowl. Another preferred embodiment includes an impact drive assembly including coin disk flange 34, a plurality of ball bearings 44, drive flange 35, spring means 36, and impact housing 37. Various other features and preferred embodiments of the coin storage and dispensing apparatus will be described in greater detail hereinafter.

Figure 3:
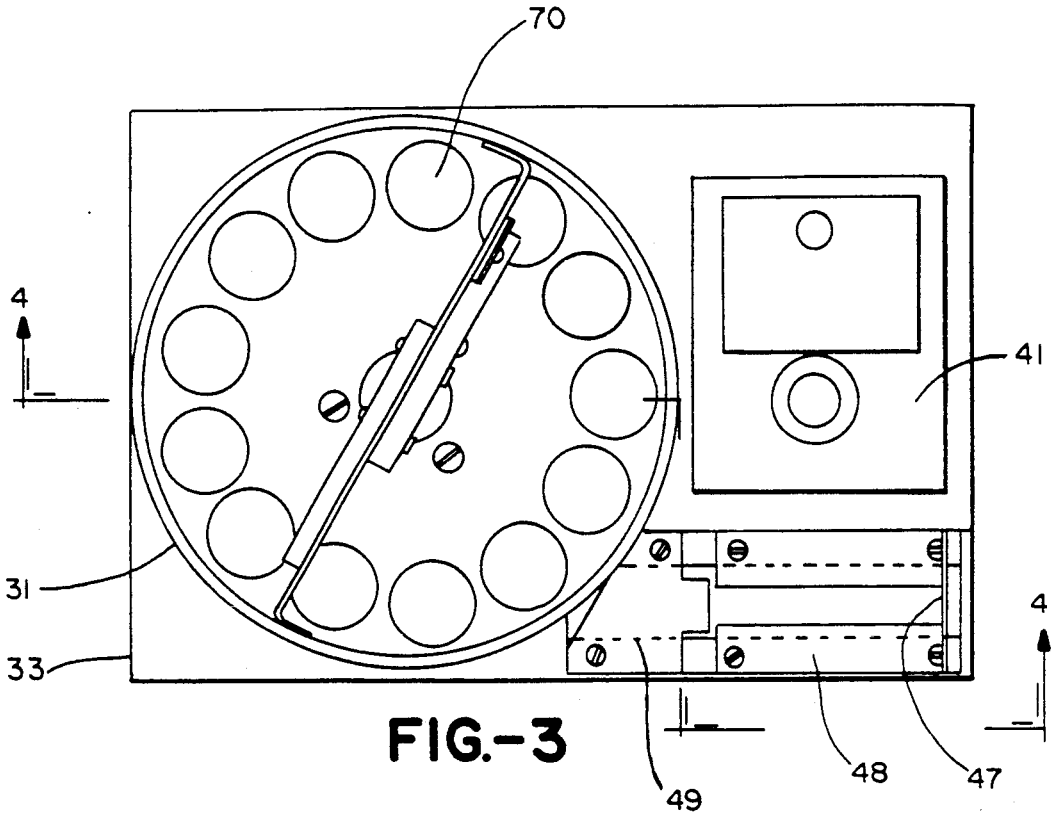
FIG. 3 shows a top plan view of the token storage and dispensing apparatus of FIG. 2.
Figure 4:
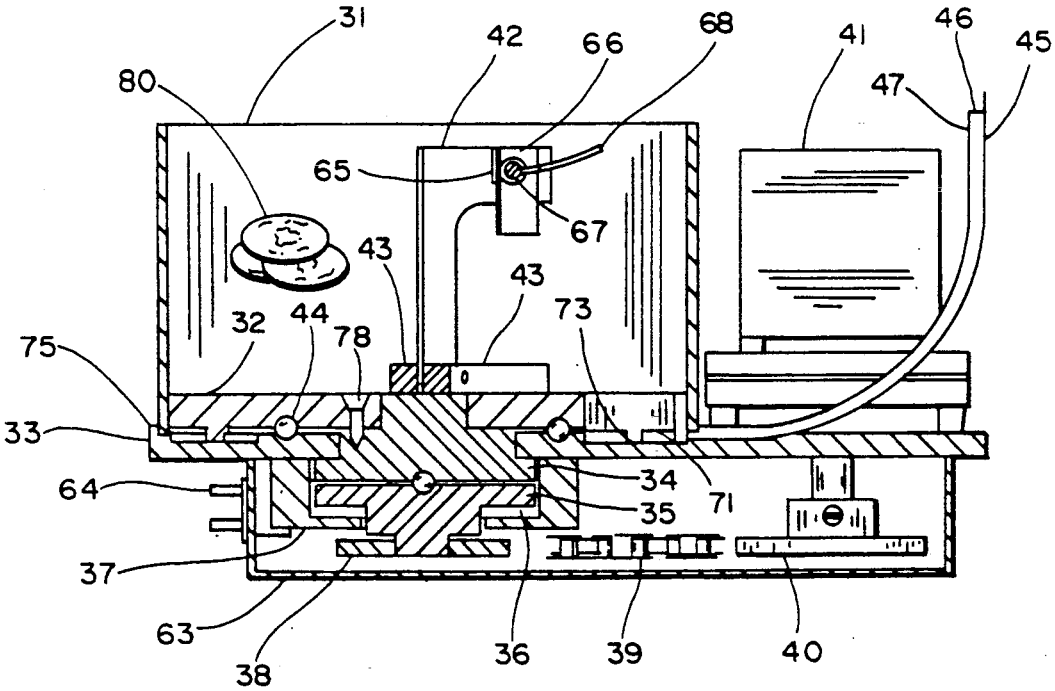
FIG. 4 shows a cross-sectional view of the coin storage and dispensing apparatus of the present invention taken substantially along line 4—4 of FIG. 3.

As shown in FIGS. 2–4, the coin hopper assembly comprises substantially cylindrical hopper bowl 31 rigidly mounted on hopper base 33, such as by welds 75 or other rigid mounting means which are well known in the art. Hopper bowl 31 is provided with coin channel 72 along a portion of its lower edge. Hopper bowl 31 may be provided in various dimensions to accommodate various numbers or denominations of coins or tokens, but it is preferably sufficiently large to accommodate several hundred coins simultaneously. In operation, the coin hopper assembly is preferably arranged in a substantially horizontal orientation, as shown in FIG. 1.

Figure 12:
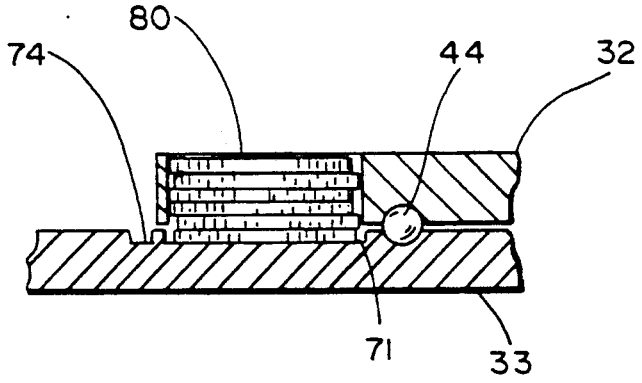
FIG. 12 shows a cross-sectional view taken substantially along line 12—12 of FIG. 11.

Coin disk 32 has a diameter slightly less than the inner diameter of coin bowl 31, so that coin disk 32 is freely rotatable with respect to coin bowl 31, and so that coins do not become lodged between the inner wall of coin bowl 31 and the peripheral edge of coin disk 32. Coin disk 32 is freely rotatable with respect to hopper base 33 by means of a plurality of ball bearings 44 which are retained in corresponding hemispherical grooves on the lower surface of coin disk 32 and the upper surface of hopper base 33. Coin disk 32 is provided with a central mounting bore and a plurality of coin pockets 70 having a diameter corresponding approximately to the diameter of the coins or tokens being collected and dispensed. Coin pockets 70 are preferably arranged in a substantially radial fashion around the periphery of the coin disk. The number of coin pockets 70 may vary depending upon the dimensions and capacity of the coin hopper assembly. According to a preferred embodiment, about eight to about twenty coin pockets 70 are provided, and most preferably from about ten to about fifteen coin pockets 70 are provided. The thickness of coin disk 32 and coin pockets 70 preferably corresponds to the thickness of several coins, such as from about three to about eight coins, so that a plurality of coins may be maintained in stacked relationship in each coin pocket 70, as shown in FIG. 12.

A preferred embodiment of coin storage and dispensing apparatus 30 includes coin mixer bracket 42 mounted in the interior space of hopper bowl 31. Diametrically opposed upper arms of mixer bracket 42 are preferably rigidly mounted on the inner surface lo of hopper bowl 31 by suitable fastening means to position flexible fingers 43 in proximity to the upper surface of coin disk 32. Flexible fingers 43 preferably comprise a resilient material such as rubber, or the like, and are preferably arranged in a generally diametrically opposed configuration, as shown. In operation, as the coin disk is rotated, the hopper bowl and the mixer bracket remain stationary, and the mixer bracket restrains the coins in the hopper bowl from rotating with the coin disk. As coin disk 32 rotates, flexible fingers 43 direct coins into coin pockets 70 until each of the coin pockets is filled with coins in vertically stacked relationship, as shown in FIG. 12.

Figure 9:
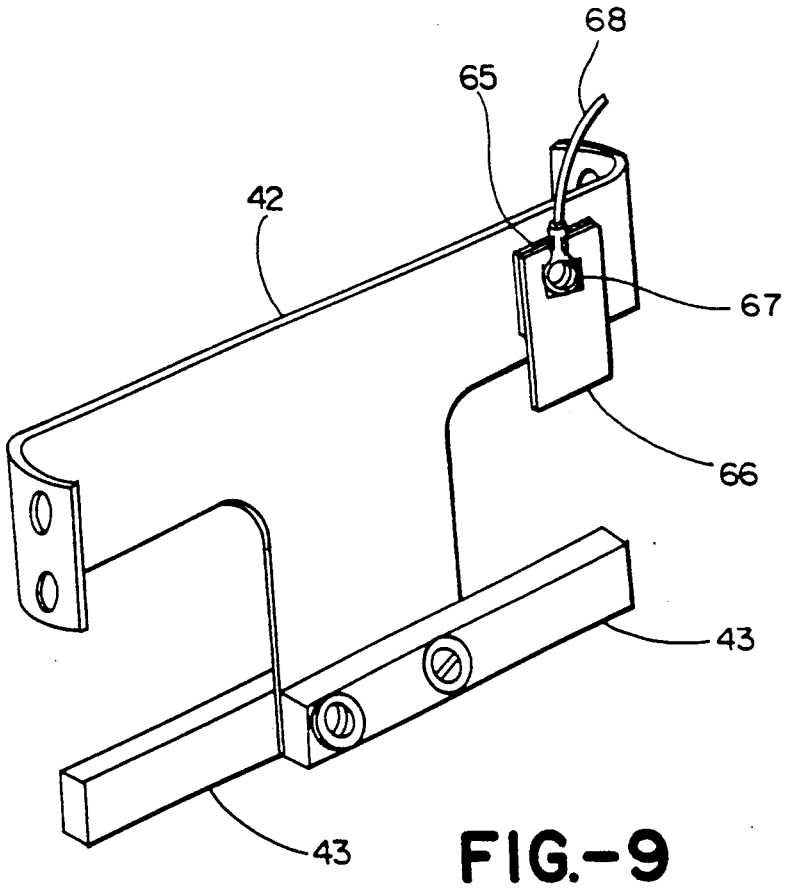
FIG. 9 shows a perspective view of a coin mixer assembly suitable for use with the coin storage and dispensing apparatus of the present invention.
Figure 10:
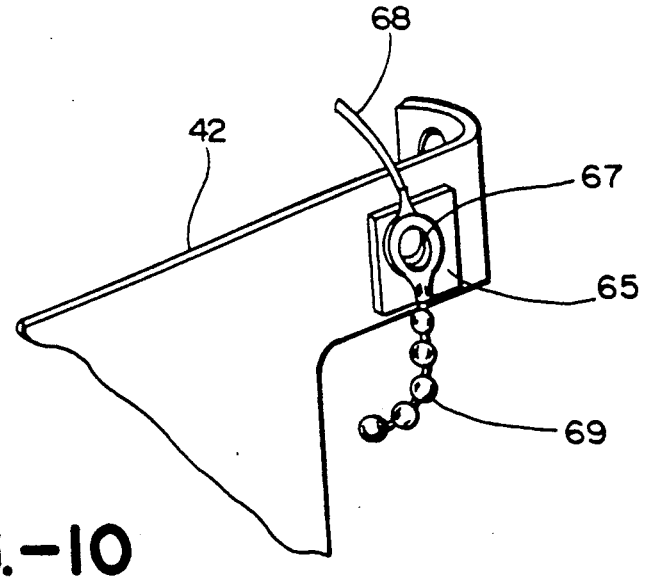
FIG. 10 shows an enlarged perspective view of another embodiment of a diverter contact switch mounted on the coin mixer assembly of FIG. 9.

According to a preferred embodiment of the present invention, coin mixer bracket 42 also includes a diverter switch assembly for regulating the level of coins 80 in hopper bowl 31. The diverter switch assembly is shown more clearly in FIGS. 9 and 10. The diverter switch assembly preferably comprises diverter contact plate 66 mounted by means of a nonconductive fastening means 67, such as a nylon screw, and a non-conductive insulating layer 65, to one of the upper arms of mixer bracket 42. Diverter contact plate 66 preferably extends below the lower edge of the mixer bracket arm, and is not in electrical contact with the mixer assembly, but is in electrical contact with diverter lead wire 68. Diverter lead wire 68 may be electrically connected to a solenoid or the like which, when actuated, diverts coins from being deposited in the coin hopper assembly to a drop box, storage bin, or the like. As illustrated in FIG. 10, diverter contact chain 69 may be used in place of diverter contact plate 66.

In operation, when the level of coins 80 in hopper bowl 31 is high enough to contact diverter contact plate 66 or diverter contact chain 69, a solenoid is actuated to divert the flow of coins from the coin hopper assembly to a drop box, or other depository. After a number of coins have been removed from the coin hopper assembly during payouts, for example, and the level of coins in hopper bowl 31 is below diverter contact plate 66 or diverter contact chain 69, electrical connection to the diverter solenoid is broken, and coins 80 are again collected in hopper bowl 31.

Figure 11:
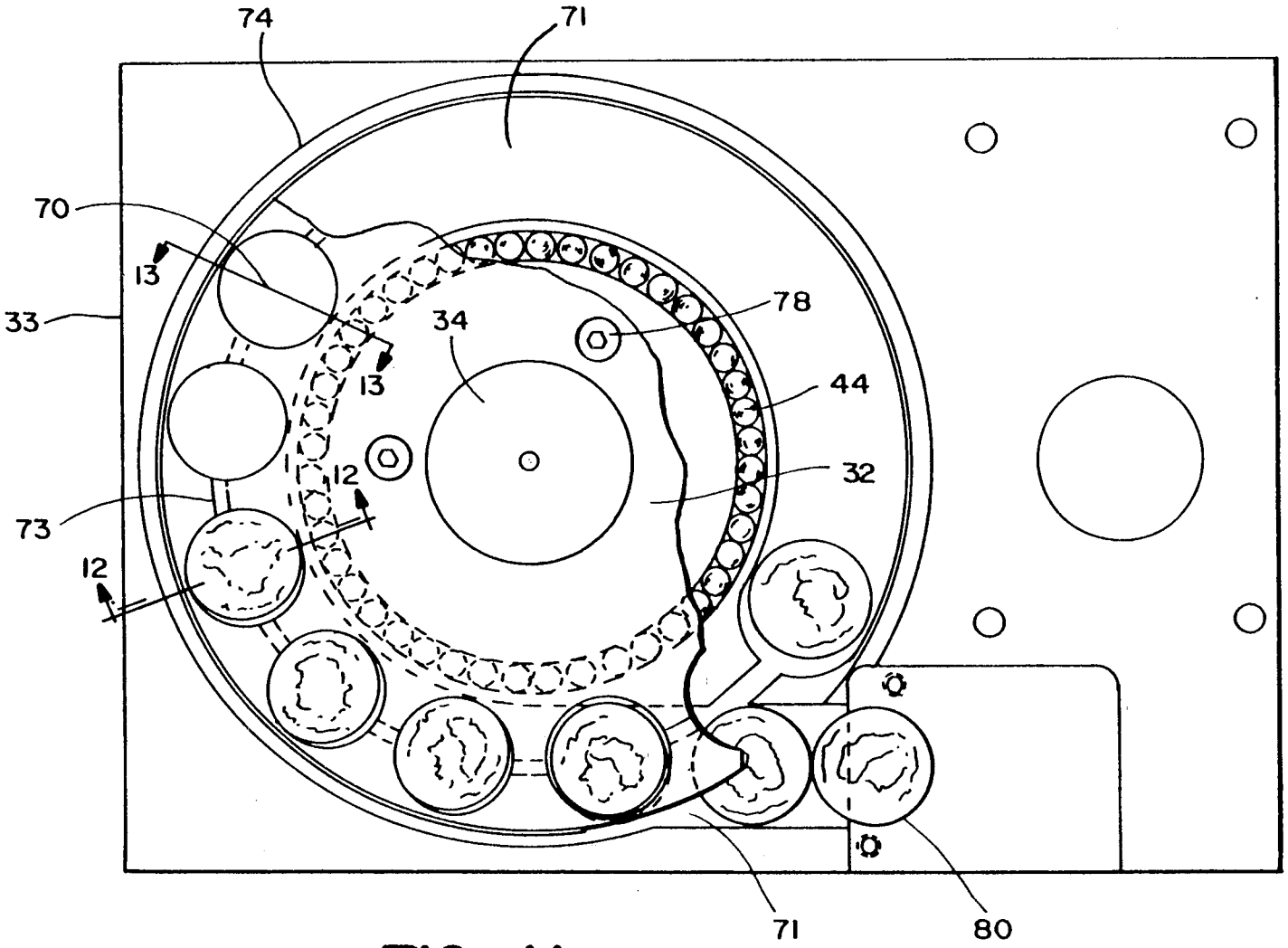
FIG. 11 shows a top plan view of the coin hopper assembly of the present invention with the token bowl removed.

As described above, coin disk 32 having a plurality of coin pockets 70 is freely rotatable with respect to hopper bowl 31 and hopper base 33. As shown more clearly in FIGS. 11–13, hopper base 33 is preferably provided with annular groove 74 for receiving the lower edge of hopper bowl 31. Adjacent and interiorly of annular groove 74, hopper base 33 is provided with a generally annular coin gutter 71 having a width corresponding generally to the diameter of the coins or tokens being collected and dispensed. As shown in FIGS. 2 and 11, coin gutter 71 is substantially annular for most of its length corresponding to the arrangement of coin pockets 70, but it is additionally provided with a straight section in proximity to coin track assembly 91 for diverting coins to the coin track assembly. According to a preferred embodiment illustrated in FIGS. 12 and 13, coin gutter 71 is slightly wider than the diameter of coin pockets 70, and has a depth corresponding approximately to the thickness of a single coin. Thus a single coin is located in the coin gutter immediately below each coin pocket at any time, and the weight of the coins 80 stacked in the coin pockets assures that the lowermost coin is held flat against the lower surface of the coin gutter at all times.

Figure 13:
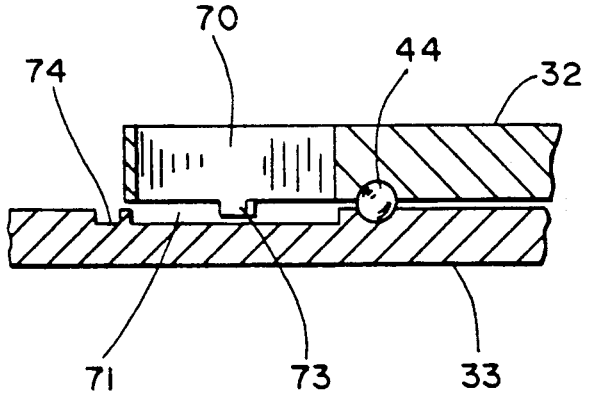
FIG. 13 shows a cross-sectional view taken substantially along line 13—13 of FIG. 11.

According to a preferred embodiment illustrated in FIG. 13, coin disk 32 is preferably provided with a plurality of coin separator lugs 73 arranged in a generally radial fashion, with a separator lug preferably positioned between each pair of adjacent coin pockets. Coin separator lugs 73 project downwardly from the lower surface of coin disk 32 into coin gutter 71 to advance coins which are positioned in the coin gutter as coin disk 32 is rotated. The provision of coin separator lugs 73 maintains the coins in coin gutter 71 in spaced relationship to prevent bumping and jamming of coins in the annular portion of coin gutter 71. Coins are maintained in spaced relationship by coin separator lugs 73 until they are directed onto the straight portion of coin gutter 71, as shown in FIG. 11.

As shown in FIG. 2, drive shaft 50 is rotated by drive motor 41. Many different types of motors are known in the art which are suitable for use in this application. According to a preferred embodiment of the present invention, drive motor 41 comprises a 35 rpm gear reduction motor. Drive shaft 50 is operatively connected to coin disk 32 to rotate the coin disk with respect to hopper bowl 31 and hopper base 33. According to a preferred embodiment, drive shaft 50 is operatively connected to coin disk 32 through a sprocket assembly and/or an impact drive assembly, as shown in FIG. 2. Drive shaft 50 is preferably rigidly engaged on drive sprocket 40, which rotates driven sprocket 38 by means of drive chain 39. Driven sprocket 38 is likewise rigidly engaged on the impact drive assembly for rotation of the impact drive assembly and coin disk 32 which is rigidly mounted thereon. According to a preferred embodiment, drive sprocket 40 has more gear teeth than driven sprocket 38, to provide a gear ratio in excess of 1.0. In this fashion, the rotational velocity of the coin disk may be increased with respect to the rotational velocity of the drive shaft without increasing the output of the drive motor.

For example, when drive motor 41 comprises a 35 rpm gear reduction motor, drive sprocket 40 is provided with 22 gear teeth, and driven sprocket 38 is provided with 18 teeth, a gear ratio of 1.22 is provided by the sprocket arrangement. This gear ratio provides rotation of the coin disk at a rate of 42.7 rpm. Rotation of a coin disk having, for example, 12 coin pockets at this rate would provide coin delivery or payout at a rate in excess of 500 coins per minute. Many other suitable sprocket arrangements and means for providing gear reduction ratios are known in the art and would be suitable for use with the coin collection and delivery apparatus of the present invention.

According to a preferred embodiment of the present invention, the coin disk is operatively engaged with the drive motor or the sprocket arrangement by means of an impact drive assembly. The impact drive assembly of the present invention provides two important functions. It eliminates or significantly reduces any damage to the drive motor or the gear box should coin jams or obstructions occur within the coin hopper assembly or coin track assembly. The impact drive assembly also facilitates release of coin jams which do occur within the coin hopper or coin track assembly, particularly coin jams which are caused by damaged or bent coins.

Figure 5:
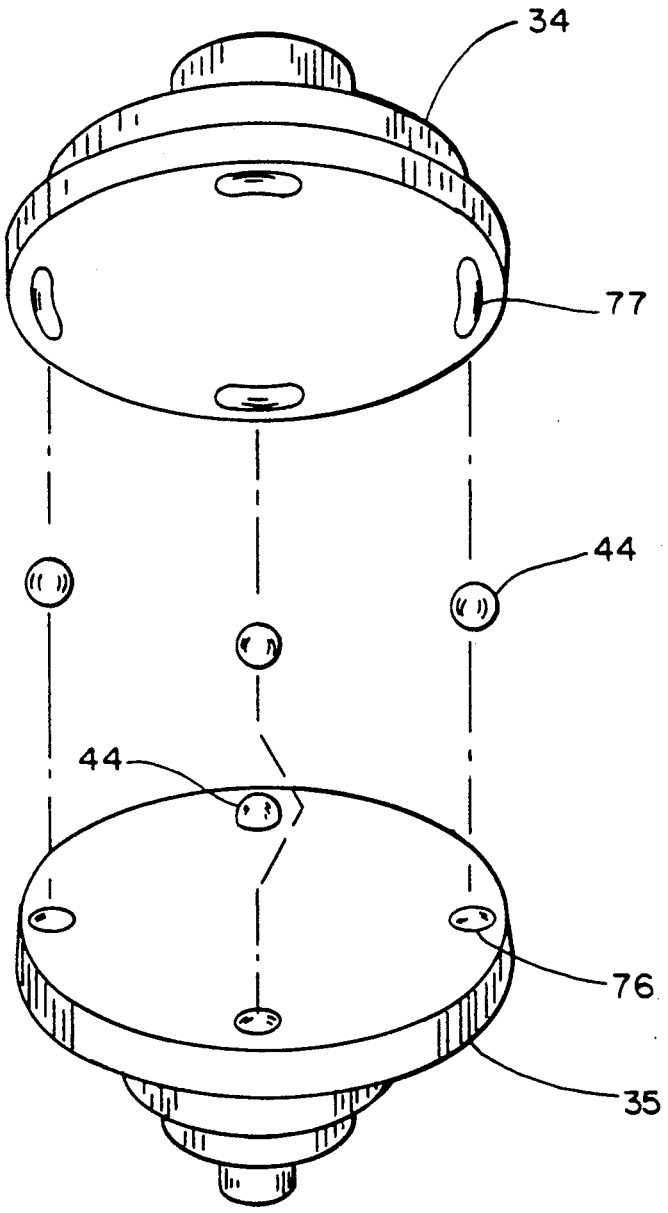
FIG. 5 shows an exploded perspective view of components of an impact drive assembly suitable for use with the coin storage and dispensing apparatus of the present invention.
Figure 6:
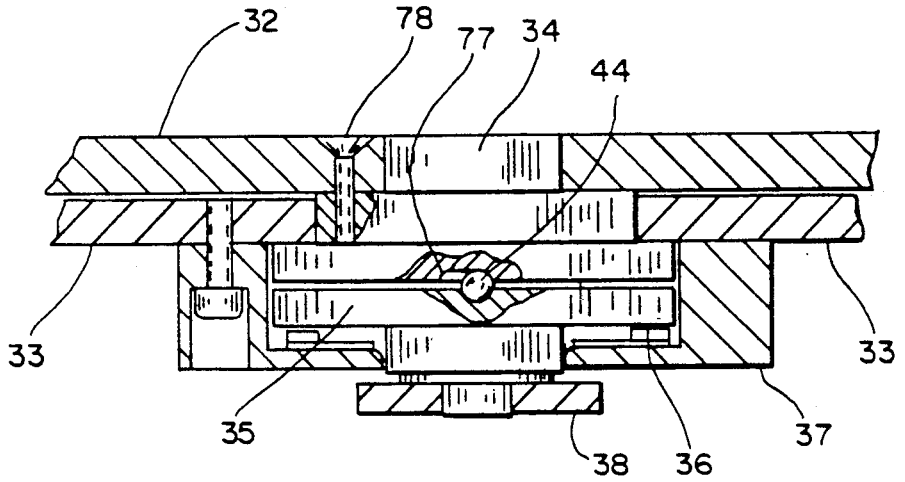
FIG. 6 shows a cross-sectional view of a coin disk and hopper base engaged with the impact drive assembly of the present invention in a normal, drive position.

As illustrated in FIGS. 2, 5 and 6, the impact drive assembly preferably comprises coin disk flange 34, a plurality of ball bearings 44, impact drive flange 35, spring means 36, and impact drive housing 37. Coin disk 32 is rigidly mounted on coin disk flange 34 forming a part of the impact drive assembly. As shown in FIGS. 2 and 4, coin disk flange 34 comprises an uppermost mounting post which is received in the central mounting bore of coin disk 32. The lower surface of coin disk 32 abuts an intermediate flange of coin disk flange 34, and the coin disk is rigidly fastened thereto by suitable fastening means such as flathead screws 78. The lower flange of coin disk flange 34 abuts the lower surface of hopper base 33, and it is rotatable with respect thereto.

Drive flange 35 is likewise provided with a plurality of graduated flanges. As shown in FIGS. 2 and 6–8, the uppermost large diameter portion of drive flange 35 is arranged adjacent and oriented parallel to the lower surface of the lower flange of coin disk flange 34, but it is separated slightly therefrom by ball bearings 44. Spring means 36 is positioned between the lower surface of the uppermost large diameter portion of drive flange 35 and impact housing 37. A central flange of drive flange 35 is received through a central bore in impact housing 37, while the lowermost mounting post of drive flange 35 projects through the central bore of impact housing 37 and is rigidly mounted on driven sprocket 38. By means of these engagements, the rotation of driven sprocket 38 is transferred through the impact drive assembly to rotate coin disk 32.

As shown in FIG. 5, coin disk flange 34 has a substantially flat lower surface with a plurality of ball detents 77 generally radially arranged therein. Generally hemispherical ball receiving cavities are correspondingly arranged on the substantially flat upper surface of drive flange 35. According to a preferred embodiment shown in FIG. 5, ball detents 77 are not hemispherical, but are elongated to permit a limited amount of rotation of coin disk flange 34 with respect to drive flange 35.

Figure 7:
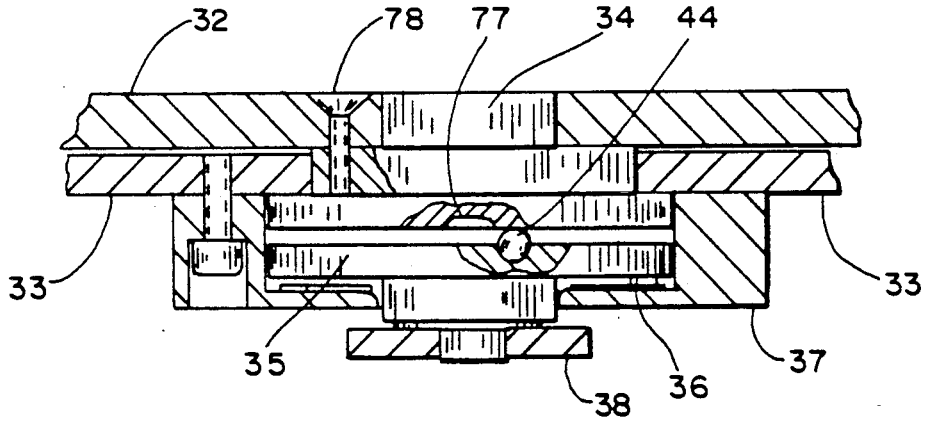
FIG. 7 shows a cross-sectional view of the coin disk, hopper base, and impact drive assembly of FIG. 6 in a jammed position.
Figure 8:
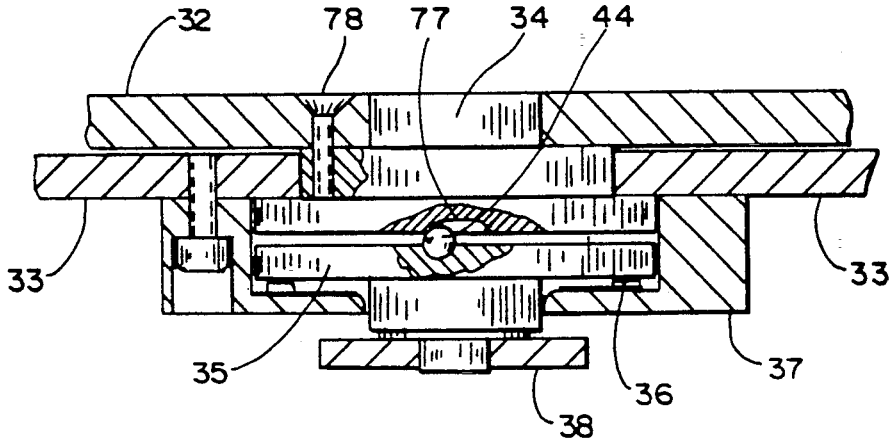
FIG. 8 shows a cross-sectional view of the coin disk, hopper base, and impact drive assembly of FIG. 6 in a release position prior to restoration of the normal, drive position shown in FIG. 6.

FIGS. 6–8 illustrate operation of the impact drive assembly in a normal, unjammed drive condition; in a jammed condition; and in a jam release condition. FIG. 6 shows the normal, unjammed position of the various components of the impact drive assembly during rotation of the assembly and the coin disk for payout of a predetermined number of coins. The ball bearings arranged between coin disk flange 34 and drive flange 35 are properly seated in ball detents 77 and hemispherical receiving cavities 76.

FIG. 7 shows the position of the various components of the impact drive assembly when a coin jams, or an obstruction occurs which causes coin disk 32 and coin disk flange 34 to cease rotating during payout of a predetermined number of coins. A coin jam or obstruction forces ball bearings 44 out of ball detents 77, which exerts a downwardly directed force on drive flange 35. The downward force on drive flange 35 causes spring means 36, preferably a finger spring or the like, to collapse, permitting continued rotation of the motor shaft during a coin jam or obstruction without damaging the drive motor or gear box. Ball bearings 44 ride along the flat lower surface of coin disk flange 34 as drive flange 35 continues to rotate. As the ball bearings roll over the leading edge of ball detents 77, as shown in FIG. 8, a momentary rotation in the opposite direction is generated, relieving force on coin disk flange 34. The ball bearings then roll along the flat surfaces of ball detents 77 until they impact with the opposite trailing edge of the ball detent. This motion is repeated until the coin jam is released or the obstruction is cleared, when the normal operating position shown in FIG. 6 is resumed.

The impact drive assembly, including impact drive housing 37, and the sprocket assembly are preferably enclosed by drive cover 63 mounted on the lower surface of hopper base 33, as shown in FIG. 4. Connector plug means 64 is preferably provided on drive cover 63 for providing electrical power to the drive motor.

As illustrated in FIG. 1, coin track assembly 91 preferably comprises generally horizontal segment 92 and generally vertical segment 94 joined by curved intermediate segment 93. Generally horizontal segment 92 of coin track assembly 91 is preferably rigidly mounted on hopper base 33 so that coin channel 52 in the coin track assembly is continuous with the straight portion of coin gutter 71. Coin track assembly 91 comprises back plate 45 having a lower substantially flat horizontal portion and a upper substantially flat vertical portion joined by a curved intermediate portion. Side rails 46 are mounted in proximity to both lateral edges of back plate 45 to form central coin channel 52. The central coin channel is preferably dimensioned to accommodate a plurality of coins in a single layer, edge-to-edge relationship. Lower pressure plate 49 is preferably mounted on side rails 46 on the lower, generally horizontal portion 92 of the coin track assembly to assure passage of coins in single layer, edge-to-edge relationship. Likewise, upper pressure plate 47 is preferably mounted on side rails 46 at the upper, generally vertical portion 94 of the coin track assembly in proximity to the curved intermediate portion to provide smooth passage of coins to the vertical portion of the coin track assembly in single layer, edge-to-edge relationship.

Figure 14:
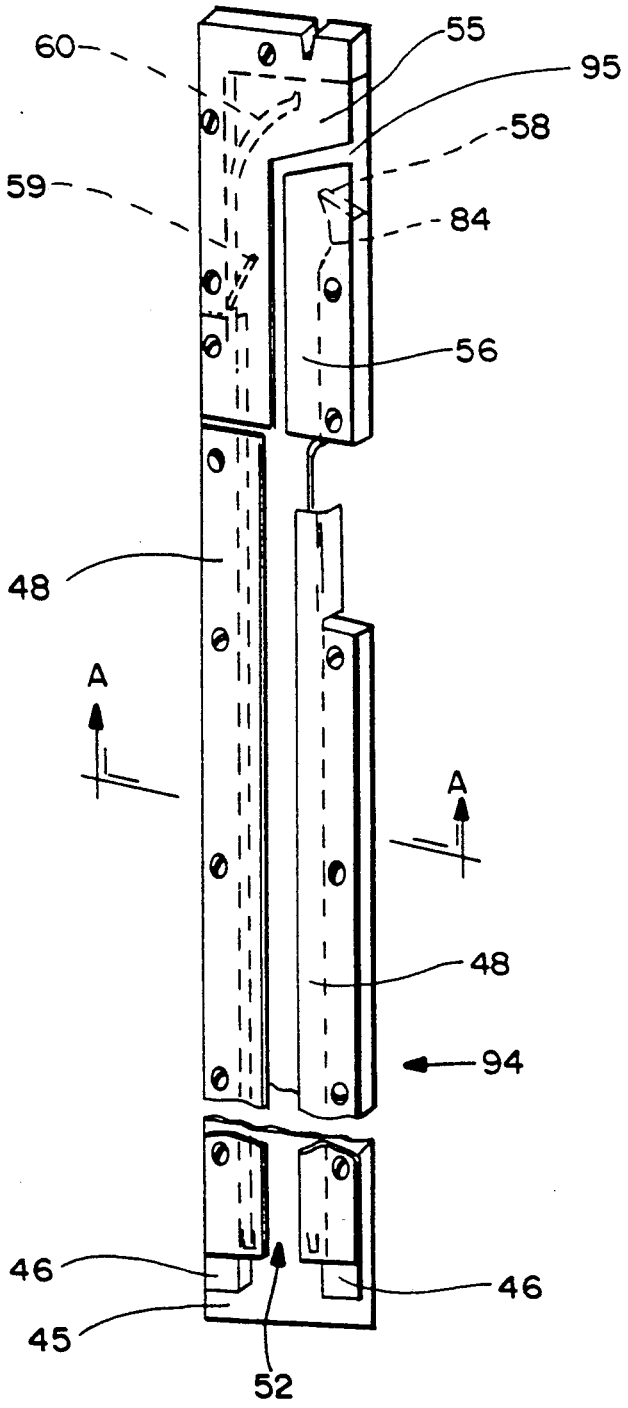
FIG. 14 shows a perspective view of the generally vertical upper portion of a coin track assembly suitable for use with the coin storage and dispensing apparatus of the present invention.

Retainer strips 48 are preferably mounted on both side rails 46 for a substantial portion of the length of the side rails. Retainer strips 48 serve to retain a single layer of coins in edge-to-edge relationship along the curved and generally vertical portions of coin track assembly 91. Retainer strips 48 preferably comprise a somewhat flexible, resilient material such as stainless spring steel or the like. Coin track assembly 91 according to the present invention may comprise a one-piece, continuous construction, or it may comprise multiple units fastened together to form a unitary, continuous coin track assembly. As shown in FIG. 14, suitable protective cover plates, such as retainer plates 55 and 56, may be mounted on the coin track assembly as necessary to protect the mechanisms mounted therein.

Figure 15:
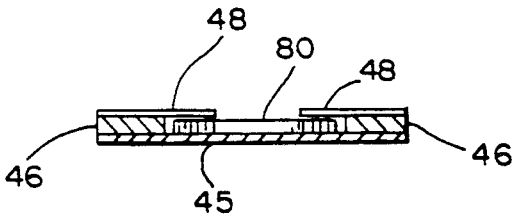
FIG. 15 shows a cross-sectional view of the coin track assembly taken substantially along line A-A of FIG. 14 with an undamaged coin therein.
Figure 16:
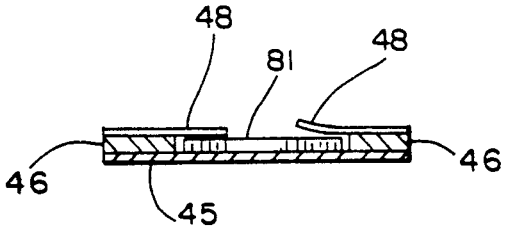
FIG. 16 shows a cross-sectional view of the coin track assembly taken substantially along line A-A of FIG. 14 with a damaged coin therein in a jammed condition.
Figure 17:
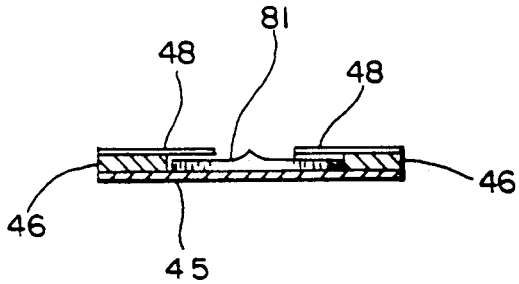
FIG. 17 shows a cross-sectional view of the coin track assembly taken substantially along line A-A of of FIG. 14 with a damaged coin therein in an operable condition.
Figure 18:
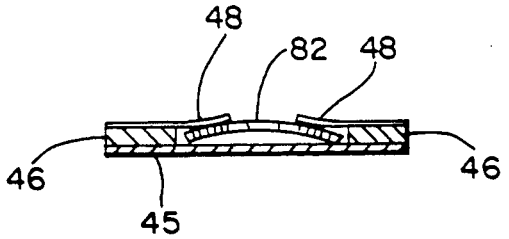
FIG. 18 shows a cross-sectional view of the coin track assembly taken substantially along line A-A of FIG. 14 with a bent coin therein in an operable condition.
Figure 19:
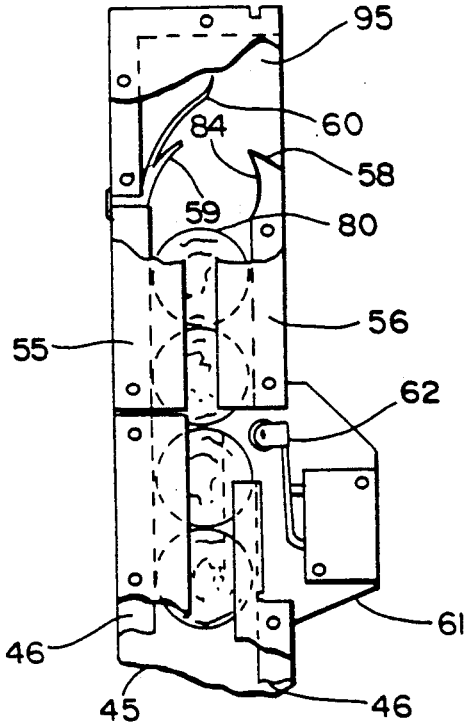
FIG. 19 shows a cut-away view of the coin counting and coin exit area of a coin track assembly suitable for use with the coin storage and dispensing apparatus of the present invention.

FIG. 14 illustrates the upper, generally vertical segment 94 of the coin track assembly. FIGS. 15–18 illustrate cross-sectional views of the generally vertical segment of the coin track assembly with damaged and undamaged coins passing therethrough. FIG. 15 shows undamaged coin 80 retained in the coin passage. FIG. 16 shows damaged coin 81, for example, a coin having a ridge or bump along its periphery wedged in the central coin channel of the coin track assembly. This condition may cause a jam in the coin track assembly which would result in operation of the impact drive assembly to avoid any damage to the drive motor or gear box. Operation of the impact drive assembly tends to rotate the coins positioned in the coin track assembly so that a damaged coin 81 in the position shown in FIG. 16 is adjusted to the position shown in FIG. 17, and the coin storage and dispensing apparatus resumes normal operation. FIG. 18 shows bent coin 82 in the central coin passage of the coin track assembly. Retainer strips 48 are preferably sufficiently flexible to accommodate bent or curved coins, as shown in FIGS. 16 and 18 without causing jamming of the apparatus. FIGS. 14 and 19–21 illustrate upper, generally vertical segment 94 of the coin track assembly, including preferred embodiments of a coin counting mechanism, an anti-theft mechanism, and a coin ejector mechanism. According to a preferred embodiment of the coin storage and dispensing apparatus of the present invention, coin counting is achieved by means of extended arm microswitch 62, which contacts coins 80 directly as they are conveyed up and out of the coin channel in the coin track assembly during a payout. Suitable microswitches are well known in the art. Extended arm microswitch 62 is preferably mounted on microswitch plate 61 and positioned to count between the third and fourth coin from coin exit slot 95. Counter microswitch 62 is preferably vertically adjustable to control the stop position of the uppermost coin in the coin track assembly so that it is properly positioned with respect to the anti-theft mechanism. Provision of counter microswitch 62 near the upper portion of the vertically extending segment of the coin track assembly provides more accurate coin counting and reduces or substantially eliminates coin counting errors resulting from coin wear or tolerance buildup within the coin track assembly.

Figure 20:
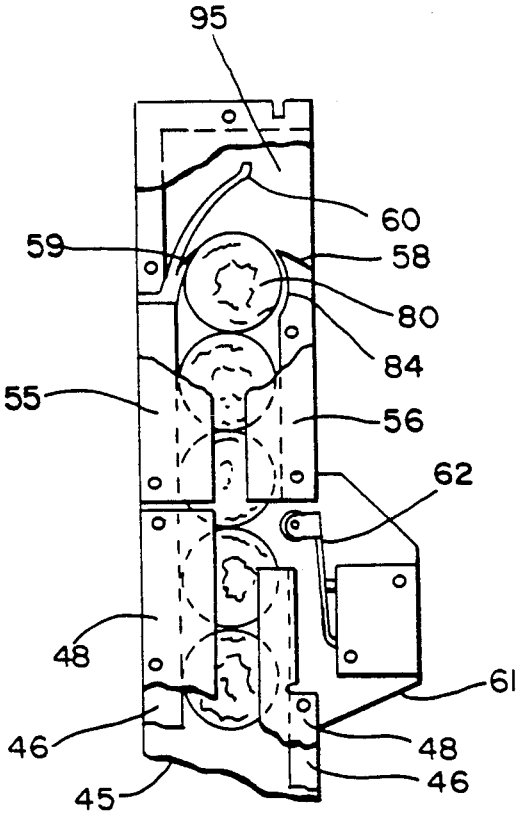
FIG. 20 shows a cut-away view of the coin counting and coin exit area as shown in FIG. 19, with the uppermost coin engaged in an anti-theft mechanism.

A preferred embodiment of the coin storage and dispensing apparatus of the present invention also includes an anti-theft mechanism for preventing removal of coins, for example, by inserting an object through coin exit slot 95 to pry coins out of the coin track assembly. The anti-theft mechanism of the present invention includes coin detent 84 and anti-theft spring 59 provided generally opposite one another in proximity to exit slot 95. At the end of a payout, the next coin in the coin track assembly is positioned between coin detent 84 and anti-theft spring 59, as shown in FIG. 20. In this position, due to the curved configuration of coin detent 84 and anti-theft spring 59, it is virtually impossible to remove coins from the coin track assembly by inserting a wire or the like through the exit slot.

Figure 21:
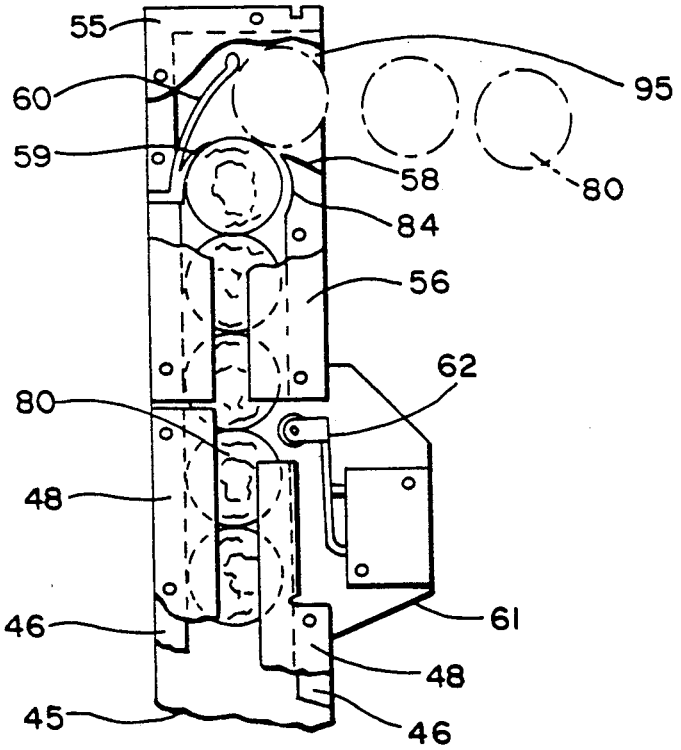
FIG. 21 shows a cut-away view of the coin counting and coin exit area as shown in FIG. 19, illustrating coins being ejected from the exit slot of the coin track assembly.

Another preferred embodiment of the coin storage and dispensing apparatus of the present invention includes coin ejector spring 60 mounted at the top of the vertical segment of the coin track assembly generally opposite coin exit slot 95. Coin ejector spring 60 functions to propel coins out through the exit slot, eliminating the collection of coins at the exit slot, which may cause coin jams. During a coin payout, anti-theft spring 59 yields and coins pass through the anti-theft mechanism. Coins then contact ejector spring 60 which yields initially to position coins in the exit slot. As coins are cleared from coin detent 84 and contact exit ramp 58, ejector spring 60 propels the coins along the exit ramp and out through the exit slot, as shown in FIG. 21.

The coin storage and dispensing apparatus of the present invention is adaptable for use with a wide variety of coins, tokens, or other objects having a generally disk-like configuration. While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A coin storage and dispensing apparatus comprising:

a coin hopper assembly including a coin bowl mounted on a hopper base and a rotatable coin disk having a plurality of coin pockets therein, said hopper base provided with a coin gutter for receiving coins from said plurality of coin pockets, and said rotatable coin disk operatively engaged with a drive means for rotation;

a coin track assembly having a coin channel therein sized to permit passage of a single layer of coins in edge-to-edge relationship, said coin track assembly including a generally horizontal portion and a generally vertical portion joined by a curved intermediate portion, and a coin exit slot in proximity to a terminal end of said generally vertical portion; and a coin mixer assembly having at least two diametrically opposed upper arms mounted on the inner surface of said coin bowl and at least two flexible fingers in proximity to the upper surface of said coin disk.

2. A coin storage and dispensing apparatus according to claim 1, wherein said coin hopper assembly is arranged in a substantially horizontal orientation.

3. A coin storage and dispensing apparatus according to claim 1, additionally comprising a diverter switch assembly mounted on said coin mixer assembly for regulating the level of coins in said hopper bowl.

4. A coin storage and dispensing apparatus according to claim wherein said coin disk is additionally provided with a plurality of coin separator lugs projecting from the lower surface, and said plurality of coin separator lugs are arranged to provide at least one coin separator lug between each pair of adjacent said coin pockets.

5. A coin storage and dispensing apparatus according to claim 1, wherein said drive means comprises a drive motor having a drive shaft engaged with a sprocket assembly to generate a gear ratio in excess of 1.0.

6. A coin storage and dispensing apparatus according to claim 1, additionally comprising an impact drive assembly operatively connected between said drive means and said rotatable coin disk to substantially eliminate damage to said drive means resulting from coin jams or malfunctions in said coin hopper assembly or said coin track assembly.

7. A coin storage and dispensing apparatus according to claim 6, wherein said impact drive assembly comprises a coin disk flange rigidly attached to said coin disk, a drive flange positioned adjacent said coin disk flange and rigidly attached to said drive means, a spring means positioned adjacent said drive flange, and an impact drive housing for maintaining said coin disk flange, said drive flange, and said spring means in adjacent relationship.

8. A coin storage and dispensing apparatus according to claim 7, wherein a plurality of ball bearings are positioned between a lower surface of said coin disk flange and an upper surface of said drive flange.

9. A coin storage and dispensing apparatus according to claim 8, wherein said lower surface of said coin disk flange is provided with a plurality of discrete ball detents and said upper surface of said drive flange is provided with a plurality of discrete receiving cavities for retaining said plurality of ball bearings.

10. A coin storage and dispensing apparatus according to claim 9, wherein said ball detents in said coin disk flange are generally radially arranged and elongated, and said receiving cavities in said drive flange are generally radially arranged corresponding to said ball detents and are generally hemispherical.

11. A coin storage and dispensing apparatus according to claim 10, wherein said spring means is compressible to permit rotation of said drive flange relative to said coin disk flange to substantially eliminate damage to said drive means resulting from coin jams or malfunctions in said coin hopper assembly and said coin track assembly.

12. A coin storage and dispensing apparatus according to claim 1, wherein said coin track assembly comprises a back plate with side rails mounted in proximity to the lateral edges of said back plate to form said coin channel, and resilient retainer strips mounted on said side rails to retain coins in said single layer, edge-to-edge relationship in said coin track assembly.

13. A coin storage and dispensing apparatus according to claim 1, wherein said coin track assembly additionally comprises a counter microswitch mounted to said generally vertical portion of said coin track assembly.

14. A coin storage and dispensing apparatus according to claim 13, wherein said counter microswitch is mounted in proximity to said coin exit slot and comprises an extended arm microswitch for contacting coins directly in said coin track assembly.

15. A coin storage and dispensing apparatus according to claim 14, wherein said counter microswitch is vertically adjustable.

16. A coin storage and dispensing apparatus according to claim 1, additionally comprising an anti-theft mechanism mounted on said coin track assembly in proximity to said coin exit slot.

17. A coin storage and dispensing apparatus according to claim 16, wherein said anti-theft mechanism comprises a curved coin detent and a curved anti-theft spring mounted generally opposite each other.

18. A coin storage and dispensing apparatus according to claim 1, additionally comprising a coin ejector means mounted in proximity to said coin exit slot.

19. A coin storage and dispensing apparatus according to claim 18, wherein said coin ejector means comprises a ejector spring mounted generally opposite said coin exit slot.

20. A coin storage and dispensing apparatus according to claim wherein said rotatable coin disk has a thickness corresponding to the thickness of several coins in a stacked relationship, and said coin gutter has a depth corresponding approximately to the thickness of a single coin.

21. A coin storage and dispensing apparatus according to claim 1, wherein said generally vertical portion comprises a vertical portion and a curved portion joined to said generally horizontal portion.

22. A coin storage and dispensing apparatus comprising:

a coin hopper assembly including a coin bowl mounted on a hopper base and a rotatable coin disk having a plurality of coin pockets therein, said hopper base provided with a coin gutter for receiving coins from said plurality of coin pockets, and said rotatable coin disk operatively engaged with a drive means for rotation;

an impact drive assembly operatively connected between said drive means and said rotatable coin disk to substantially eliminate damage to said drive means resulting from coin jams of malfunctions in said coin hopper assembly; and said impact drive assembly including a coin disk flange rigidly attached to said coin disk, a drive flange positioned adjacent and below said coin disk flange and rigidly attached to said drive means, a spring means positioned between said drive flange and an impact drive housing, said impact housing maintaining said coin disk flange, said drive flange, and said spring means in adjacent relationship.

23. A coin storage and dispensing apparatus according to claim 22, wherein a plurality of ball bearings are positioned between a lower surface of said coin disk flange and an upper surface of said drive flange.

24. A coin storage and dispensing apparatus according to claim 23, wherein said lower surface of said coin disk flange is provided with a plurality of discrete ball detents and said upper surface of said drive flange is provided with a plurality of discrete receiving cavities for retaining said plurality of ball bearings.

25. A coin storage and dispensing apparatus according to claim 24, wherein said ball detents in said coin disk flange are generally radially arranged and elongated, and said receiving cavities in said drive flange are generally radially arranged corresponding to said ball detents and are generally hemispherical.

26. A coin storage and dispensing apparatus according to claim 25, wherein said spring means is compressible to permit rotation of said drive flange relative to said coin disk flange to substantially eliminate damage to said drive means resulting from coin jams or malfunctions.

* * * * *

UNITED STATES PATENT AND TRADEMARK OFFICE

CERTIFICATE OF CORRECTION

PATENT NO. : 5,046,989

DATED : September 10, 1991

INVENTOR(S) : Jack D. Dass

It is certified that error appears in the above-identified patent and that said Letters Patent is hereby corrected as shown below:

In claim 4, column 10, line 60, after "claim" insert --1,--.

In claim 20, column 12, line 11, after "claim" insert --1,--.

Signed and Sealed this

Fifth Day of October, 1993

*Attest:*

*Attesting Officer*

BRUCE LEHMAN

*Commissioner of Patents and Trademarks*